US010254700B2

(12) United States Patent
Kobayashi

(10) Patent No.: US 10,254,700 B2
(45) Date of Patent: Apr. 9, 2019

(54) IMAGE FORMING SYSTEM AND IMAGE FORMING APPARATUS

(71) Applicant: FUJI XEROX CO., LTD., Tokyo (JP)

(72) Inventor: Kazuhide Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/633,873

(22) Filed: Jun. 27, 2017

(65) Prior Publication Data

US 2018/0224788 A1 Aug. 9, 2018

(30) Foreign Application Priority Data

Feb. 8, 2017 (JP) ..... 2017-020839

(51) Int. Cl.

| | |
|---|---|
| ***G03G 15/00*** | (2006.01) |
| ***B41J 2/14*** | (2006.01) |
| ***B41J 15/00*** | (2006.01) |
| ***B41J 2/165*** | (2006.01) |
| ***B41J 3/60*** | (2006.01) |

(52) U.S. Cl.

CPC ..... *G03G 15/657* (2013.01); *B41J 2/14161* (2013.01); *B41J 2/16505* (2013.01); *B41J 3/60* (2013.01); *B41J 15/005* (2013.01); *G03G 15/6564* (2013.01); *G03G 2215/00455* (2013.01); *G03G 2215/00679* (2013.01)

(58) Field of Classification Search

CPC ..... B41J 2/165; B41J 2/16538; B41J 2002/16502; B41J 2/16505; B41J 2/16523; B41J 2/16547; B41J 2/16511; B41J 2/1754; B41J 2/1753; B41J 2/17536

See application file for complete search history.

(56) References Cited

U.S. PATENT DOCUMENTS 8,096,635 B2 * 1/2012 Berry ..... B41J 2/16585 347/32
2008/0218551 A1 * 9/2008 Inaba ..... B41J 2/16517 347/23

FOREIGN PATENT DOCUMENTS

| | | |
|---|---|---|
| JP | H07-314701 | 12/1995 |
| JP | 2011-056770 | 3/2011 |
| JP | 2011-152661 | 8/2011 |

OTHER PUBLICATIONS

Abstract and machine translation of JP H07-314701.
Abstract and machine translation of JP 2011-152661.
Abstract and machine translation of JP 2011-056770.

* cited by examiner

*Primary Examiner* — Kristal Feggins
(74) *Attorney, Agent, or Firm* — Fildes & Outland, P.C.

(57) ABSTRACT

An image forming system includes: a first image forming apparatus that is disposed at an upstream side in a feeding direction of a belt-like continuous recording medium; and a second image forming apparatus that is disposed at a downstream side in the feeding direction of the recording medium, wherein each of the first image forming apparatus and the second image forming apparatus includes: a recording head that forms images on the recording medium by ejecting droplets from ejection outlets of the recording head; a closing member that serves to close the ejection outlets; and a controller that monitors head drive data for driving of the recording head, and closes the ejection outlets with the closing member in case a droplets non-ejection state is beyond a predetermined first allowable condition during printing.

10 Claims, 13 Drawing Sheets

2(3)

IMAGE FORMING SYSTEM AND IMAGE FORMING APPARATUS

CROSS-REFERENCE TO RELATED APPLICATIONS

This application is based on and claims priority under 35 USC 119 from Japanese Patent Application No. 2017-020839 filed on Feb. 8, 2017.

BACKGROUND

Technical Field

The present invention relates to an image forming system and an image forming apparatus.

SUMMARY

According to an aspect of the invention, there is provided an image forming system comprising: a first image forming apparatus that is disposed on an upstream side in a feeding direction of a belt-like continuous recording medium; and a second image forming apparatus that is disposed on a downstream side in the feeding direction of the recording medium, wherein each of the first image forming apparatus and the second image forming apparatus comprises: a recording head that forms images on the recording medium by ejecting droplets from ejection outlets; a closing member that serves to close the ejection outlets; and a controller that monitors head drive data for driving of the recording head, and closes the ejection outlets with the closing member if a droplets non-ejection state is beyond a predetermined first allowable condition during printing.

BRIEF DESCRIPTION OF THE DRAWINGS

Exemplary embodiments of the present invention will be described in detail based on the following figures, wherein.

DESCRIPTION OF SYMBOLS

1 . . . Cascade printing system; 1A . . . Printing system; 2, 2A, 3 . . . Printing apparatus; 4 . . . Flipping device; 19, 19A, 19B . . . Head unit; 21 . . . Nozzle cap.

DETAILED DESCRIPTION

Exemplary embodiments of the present invention will be hereinafter described in detail with reference to the accompanying drawings.

Exemplary Embodiment 1

<Overall Configuration>

Figure 1:
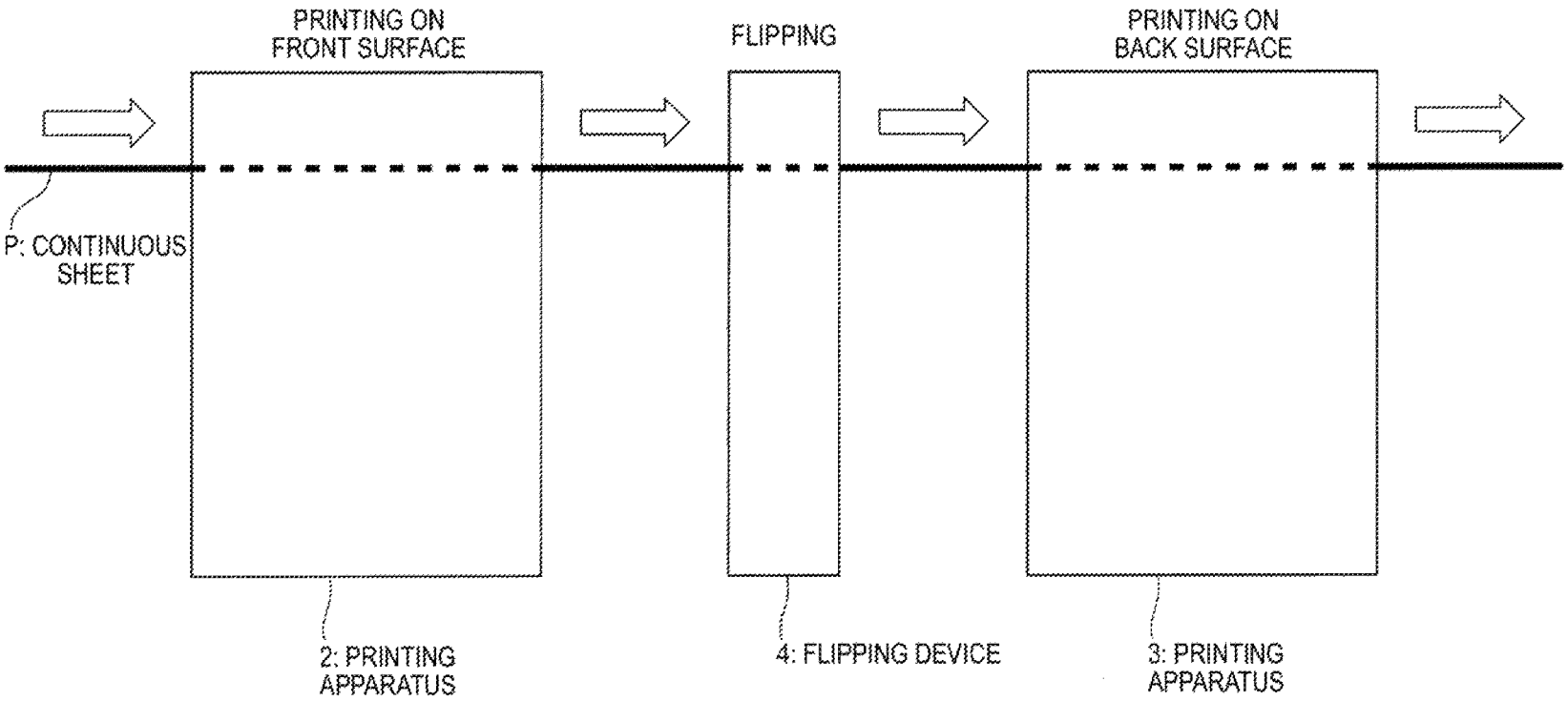
FIG. 1 is a block diagram showing an example overall configuration of a cascade printing system according to a first exemplary embodiment.

FIG. 1 is a block diagram showing an example overall configuration of a cascade printing system 1 according to a first exemplary embodiment. In the printing system 1 according to this exemplary embodiment, two printing apparatus 2 and 3 are connected to each other in cascade and a flipping device 4 is disposed between them. The flipping device 4 flips a continuous sheet P so that a printing surface for the printing apparatus 2 is made a non-printing surface for the printing apparatus 3.

In this exemplary embodiment, the printing apparatus 2 and 3 serve for printing on the front surface and the back surface, respectively. Alternatively, the printing apparatus 2 and 3 may serve for printing on the back surface and the front surface, respectively. Each of the printing apparatus 2 and 3 is an inkjet type apparatus that forms an image on the surface of a target in a non-contact manner by ejecting very small droplets toward the target.

The cascade printing system 1 is an example of the "image forming system", and each of the printing apparatus 2 and 3 is an example of the "image forming apparatus" and they are also examples of the "first image forming apparatus" and the "second image forming apparatus", respectively.

In the exemplary embodiment, a sheet supply device (not shown) is disposed upstream of the printing apparatus 2 and supplies a belt-like continuous sheet P continuously. The continuous sheet P is an example of the "recording medium".

The continuous sheet P is housed in the sheet supply device (not shown) in a state that it is wound like a roll. As a printing operation proceeds, the continuous sheet P is carried into the printing apparatus 2 which is located on the upstream side in the conveyance path and ejected from it to the printing apparatus 3 which is located on the downstream side in the conveyance path.

The printing apparatus 2 prints front-page images successively on the front surface of the continuous sheet P, and the printing apparatus 3 prints back-page images successively on the back surface of the same continuous sheet P. In this manner, in the exemplary embodiment, the printing apparatus 2 and 3 perform printing on a page-by-page basis.

In the exemplary embodiment, images to be printed are business form images and the printing apparatus 2 and 3 share work of printing the same business form, that is, they print different sets of pages of the business form. More specifically, the printing apparatus 2 prints front-page images of a business form on the front surface of the continuous sheet P, and the printing apparatus 3 prints back-page images of the business form on the back surface (i.e., the surface that is different from the surface on which the printing apparatus 2 performs printing) of the same continuous sheet P.

In the exemplary embodiment, it is assumed that the business form is a bill. However, the business form is not limited to a bill and may be an application form, a bank transfer form, a contract document, an order form, a delivery statement, contact details, details of services used, deal details, a products register, a process management table, a components list, or the like.

In the case of bills, whereas there is a basic form that is common to individual bills, the name of the person or company charged, his/her or its address, charging items, etc. vary from one bill to another. Thus, images corresponding to respective persons or companies charged are printed on respective bills.

As mentioned above, front-page images and back-page images of business forms are printed successively on the front surface and the back surface of the continuous sheet P, respectively. Thus, after being subjected to printing, the continuous sheet P is a continuation of a number of business forms (printed documents). The printed continuous sheet P are cut into separate, individual business forms by a post-processing device (not shown).

<Hardware Configuration of Printing Apparatus 2 and 3>

Figure 2:
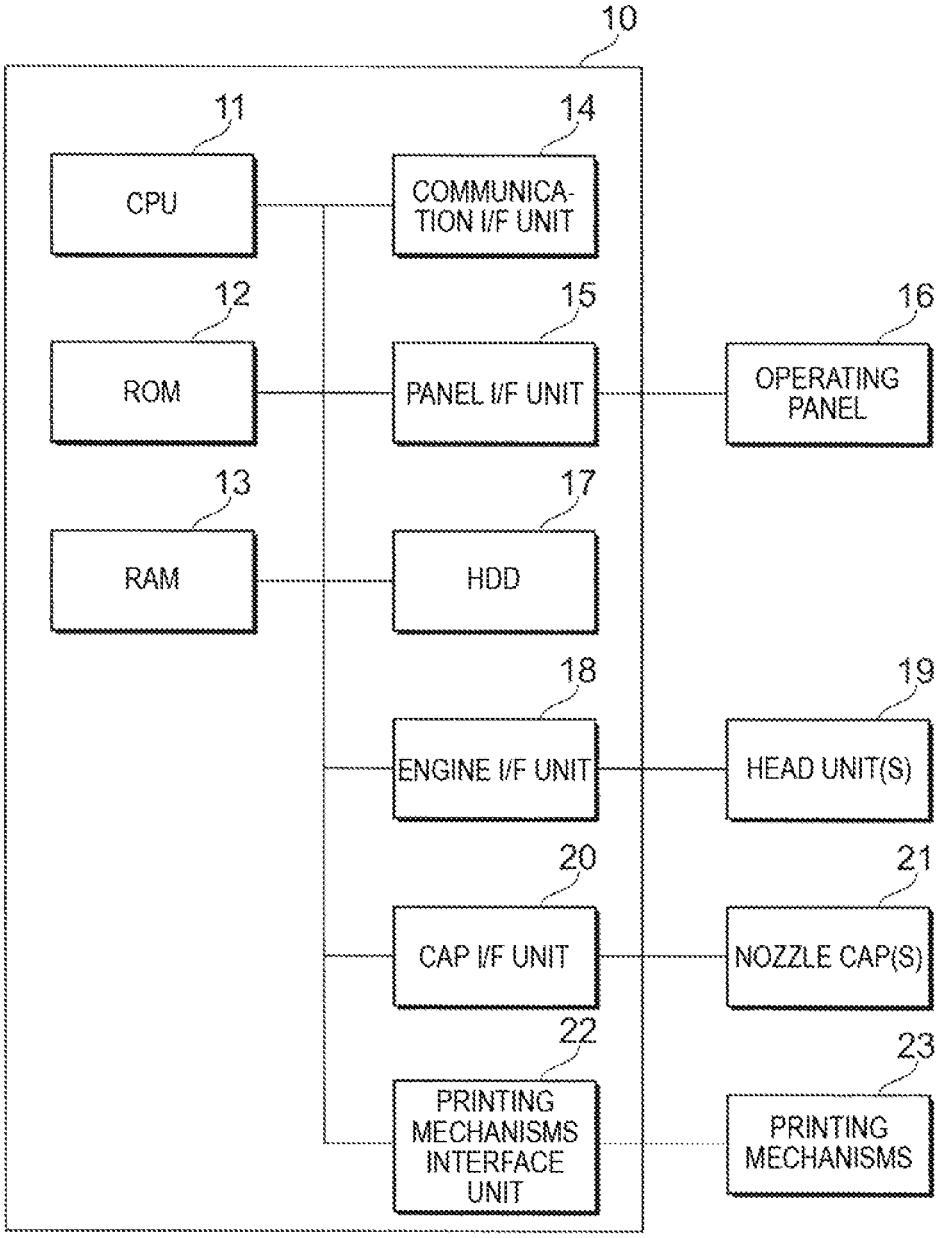
FIG. 2 is a block diagram showing an example hardware configuration of each printing apparatus.

Next, detailed configurations of the printing apparatus 2 and 3 which are parts of the cascade printing system 1 will be described. FIG. 2 is a block diagram showing an example hardware configuration of each of the printing apparatus 2 and 3; this hardware configuration is common to the printing apparatus 2 and 3.

The following description will be made in such a manner as to be directed to the printing apparatus 2. The printing apparatus 2 has a controller 10, which is equipped with a CPU (central processing unit) 11, a ROM (read-only memory) 12 which is stored with, among other things, programs to be executed by the CPU 11, a RAM (random access memory) 13 which serves as a working area of the CPU 11. These components constitute a common computer.

For example, the CPU 11 functions as a data processing unit by executing programs. When functioning as a data processing unit, the CPU 11 performs, for example, processing of extracting, from image data, images to be printed on the surface (front surface) in its charge and recombining them (including rearrangement) into printing order.

The controller 10 is also equipped with a communication interface 14, which is used for communication with an external device. For example, the communication interface 14 is used for communication with a host apparatus (not shown) or a terminal apparatus (not shown) and for communication with the printing apparatus 3 which is the other printing apparatus of the cascade printing system 1.

When functioning as a data processing unit, the CPU 11 receives image data from the host apparatus (not shown) using the communication interface 14. The CPU 11, which corresponds to the "controller", receives control data from the terminal apparatus (not shown) using the communication interface 14.

An engine interface unit 18 (described later) communicates with the CPU 11 and the engine interface unit 18 of the other printing apparatus 3 using the communication interface 14.

The controller 10 is also equipped with a panel interface unit 15, which is used for communication with an operating panel 16. The panel interface unit 15 generates and displays on the operating panel 18 a manipulation picture (user interface picture). Furthermore, the panel interface unit 15 detects a manipulation input to the operating panel 16 and sends information indicating it to the CPU 11.

The controller 10 is also equipped with an HDD (hard disk drive) 17 which is an example nonvolatile storage device. The CPU 11 writes and reads various kinds of data to and from the HDD 17. Image data and control programs received from the host apparatus (not shown) etc. are stored in the HDD 17.

The controller 10 is further equipped with the engine interface unit 18, which is used for driving a head unit(s) 19. The engine interface unit 18 generates head drive data for driving individual nozzles of the head unit (s) 19 on the basis of image data (of business forms, for example) that are received from the CPU 11 serving as a data processing unit, and controls its operation of ejecting very small ink droplets.

In the exemplary embodiment, a group of nozzles are arranged in the ejection surface of the (or each) head unit 19 parallel with the width direction of the continuous sheet P. The group of nozzles are arranged in a single row or plural rows that are arranged in the feeding direction of the continuous sheet P. Each nozzle is an example of the (droplet) "ejection outlet".

Figure 3:
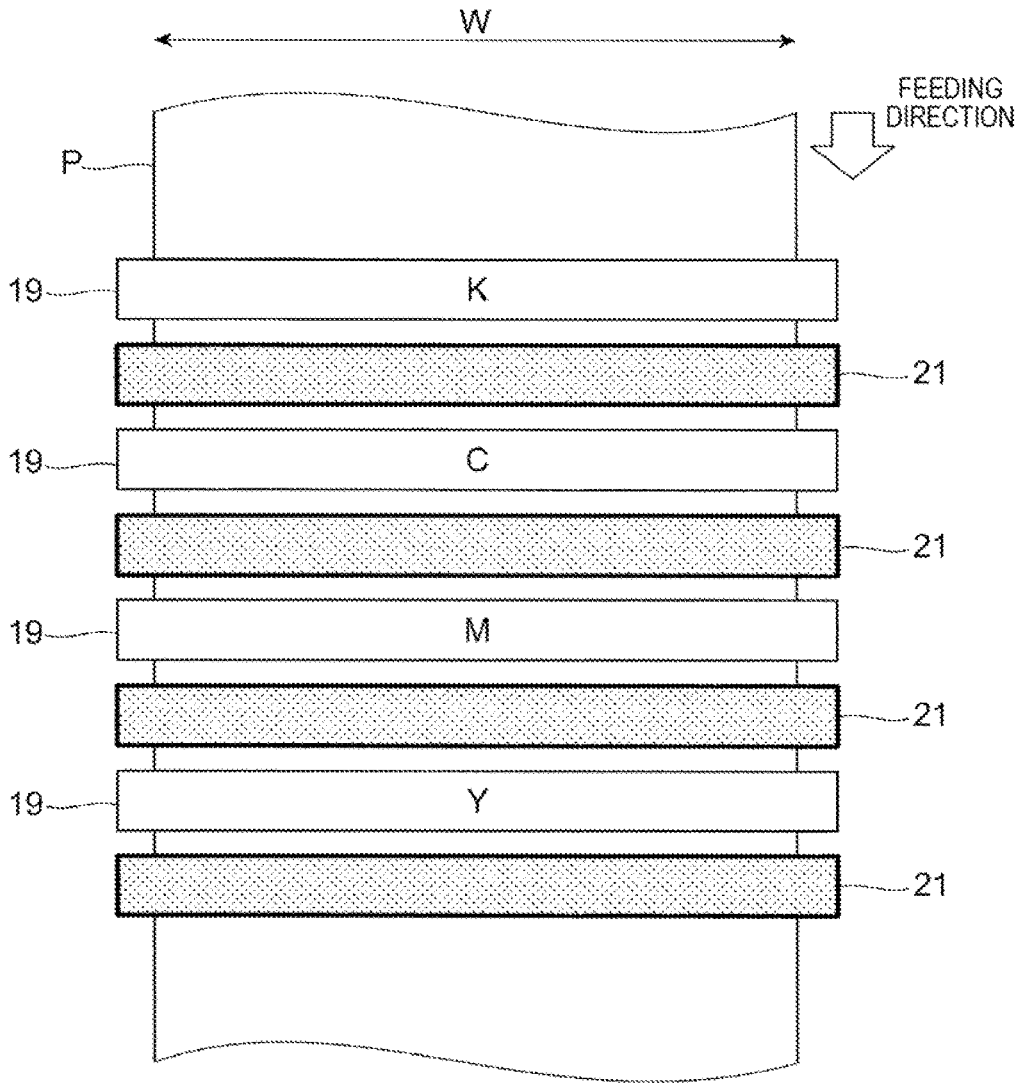
FIG. 3 shows an example arrangement of head units in a case that the printing apparatus is a color printing apparatus.

FIG. 3 shows an example arrangement of the head units 19 in a case that the printing apparatus 2 is a color printing apparatus. The arrangement shown in FIG. 3 is for a printing method called a single-pass method in which case the length of each head unit 19 is longer than the width W of the continuous sheet P. In the example of FIG. 3, four head units 19 corresponding to black (K), cyan (C), magenta (M), and yellow (Y) are disposed independently of each other and arranged in this order downstream in the feeding direction of the continuous sheet P.

Instead of employing the individual head units 19 corresponding to cyan (C), magenta (M), and yellow (Y), an integrated head unit of these head units 19 may be employed.

Although the exemplary embodiment is directed to the case that sets of ink droplets corresponding to the four respective colors are ejected, the printing apparatus 2 may be configured so that two sets of ink droplets having different densities can be ejected for each color. For example, five head units 19 may be employed so that two sets of ink droplets can be ejected only for black (K).

Figure 4:
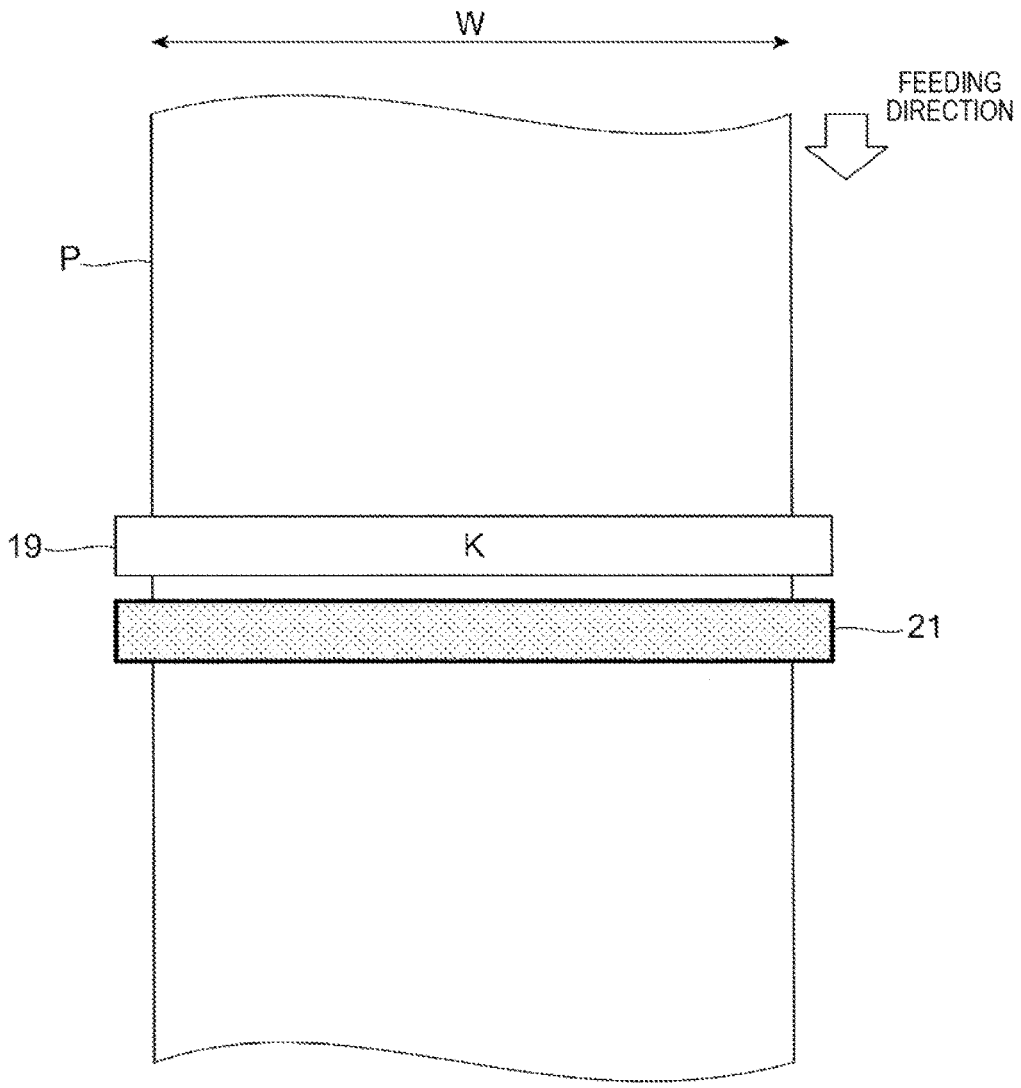
FIG. 4 shows an example manner of disposition of a head unit in a case that the printing apparatus is dedicated to monochrome printing.

FIG. 4 shows an example manner of disposition of the head unit 19 in a case that the printing apparatus 2 is dedicated to monochrome printing. In the example of FIG. 4, only one head unit 19 corresponding to black (K) is disposed.

In the exemplary embodiment, the engine interface unit 18 also controls dummy jetting and a purge operation.

Returning to FIG. 2, the controller 10 is also equipped with a cap interface unit 20, which is used for driving a nozzle cap(s) 21. The (or each) nozzle cap 21, which is a member for preventing nozzle clogging due to dried ink, is attached to or detached from the associated head unit 19. The nozzle cap 21 is an example of the "closing member".

In the exemplary embodiments, it is assumed that to cap the head unit(s) 19 with the nozzle cap(s) 21 or uncap the head unit(s) 19, it is necessary to suspend operation of the printing apparatus 2 and 3 temporarily. That is, to cap or uncap the head unit(s) 19, a printing operation itself is suspended temporarily and restarted after completion of the capping or uncapping.

However, where the printing apparatus 2 and 3 are of such types that the head unit(s) 19 can be capped and uncapped while a printing operation is continued, it is not necessary to suspend a printing operation for capping or uncapping.

In the exemplary embodiment, the (or each) nozzle cap 21 has dimensions that are necessary for capping of the nozzles that are formed in the ejection surface of the head unit 19 to be capped with it, and is disposed adjacent to the head unit 19 (see FIGS. 3 and 4).

In a state that the head unit 19 is covered with the nozzle cap 21, all of the nozzles formed in the ejection surface of the head unit 19 are insulated from the air around the nozzle cap 21 and thereby prevented from being dried.

The cap interface unit 20 employed in the exemplary embodiment controls movement of the (or each) nozzle cap 21 between a standby position and the position where it is opposed to the ejection surface of the associated head unit 19.

To cap the (or each) head unit 19 with the associated nozzle cap 21, the target head unit 19 is retreated away from the continuous sheet P temporarily by means of a moving mechanism (not shown). Then the cap interface unit 20 moves the nozzle cap 21 to the position where it is opposed to the ejection surface of the head unit 19. Subsequently, the movement mechanism (not shown) moves the nozzle cap 21 so that it is pressed against the head unit 19, whereby the nozzle cap 21 is brought into close contact with the nozzles arranged in the ejection surface. An opposite operation is performed to uncap the head unit 19.

An alternative drive method may be employed in which the attaching position of the (or each) nozzle cap 21 is fixed and the associated head unit 19 is moved to that position.

The controller 10 is also equipped with printing mechanisms interface unit 22, which is used for driving printing mechanisms 23. The printing mechanisms 23 include mechanisms relating to image formation using the head unit(s) 19 and mechanisms relating to conveyance of the continuous sheet P.

<Capping Control Operation>

Next, a description will be made of a capping control operation that, is performed by the CPU 11 of each of the printing apparatus 2 and 3 at a start of and during printing.

In the exemplary embodiment, the term "start of printing" means a start of operation of the mechanical portions (mechanisms) of each of the printing apparatus 2 and 3 start operating in a state that the ejection surface of the (or each) head unit 19 is capped with the nozzle cap 21. For example, the start of printing includes that printing is started when a new print job is received by the printing apparatus 2 and 3 being in a halt state, and that printing is restarted during execution of a print job from a state that the ejection surface of the (or each) head unit 19 is capped with the nozzle cap 21 temporarily.

In the exemplary embodiment, the term "during printing" refers to a period when images of a print job are printed or a period when the mechanical portions (mechanisms) of each of the printing apparatus 2 and 3 operate on the basis of a print job.

Figure 5:
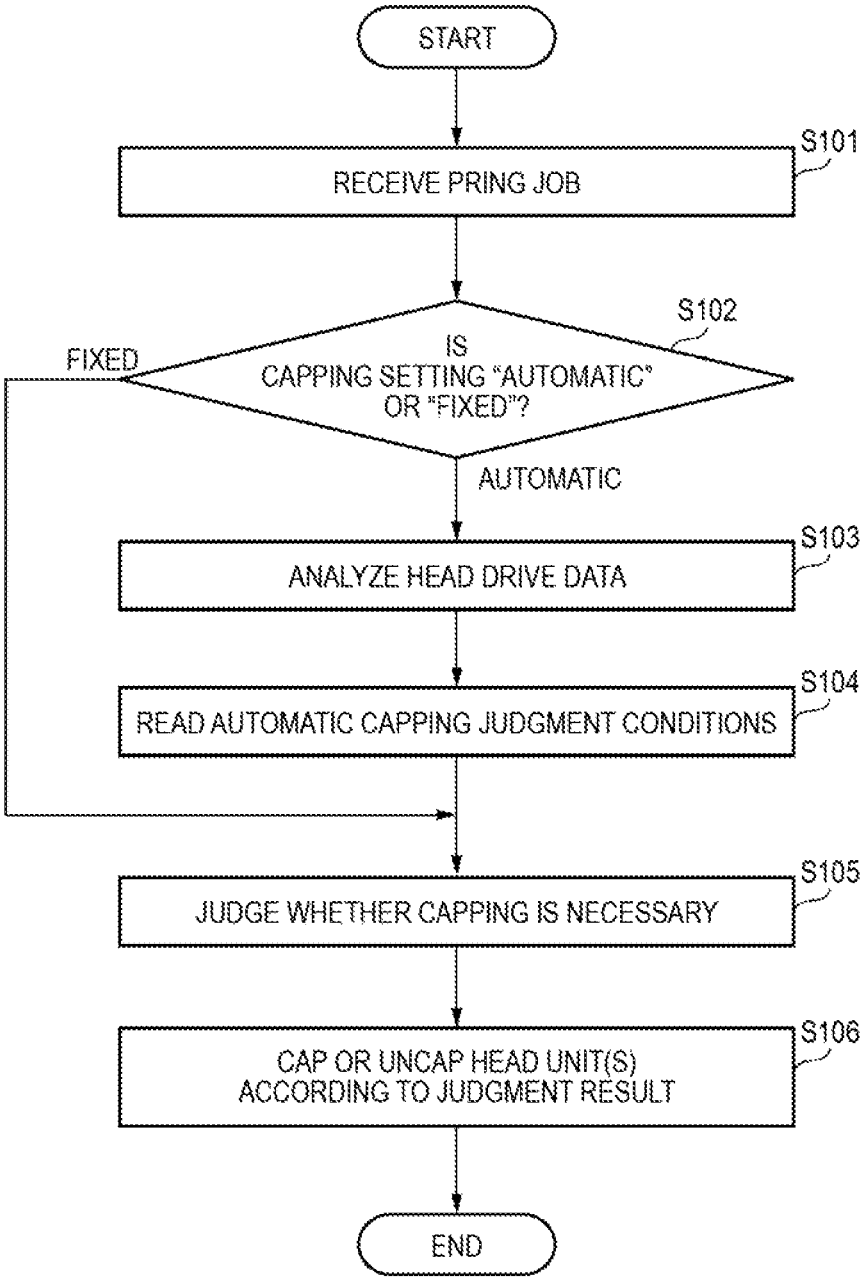
FIG. 5 is a flowchart illustrating an example capping control operation that is performed by a CPU.

FIG. 5 is a flowchart illustrating an example capping control operation that is performed by the CPU 11 repeatedly.

When receiving a print job through the communication interface unit 14 or the operating panel 16 at step S101, at step S102 the CPU 11 judges whether the capping setting is "automatic" or "fixed."

The capping setting has been made by a user in advance through a setting picture displayed on the operating panel 16.

The setting "fixed" includes two kinds of settings, that is, a setting that a particular head unit(s) 19 is capped all the time and a setting that a particular head unit(s) 19 is not capped all the time. A setting target head unit(s) 19 may be designated individually or in a group. When employing the setting "fixed," the user selects one of these two kinds of settings.

The setting "automatic" is a setting that a capping operation is left to a control of the printing apparatus 2 (CPU 11). The details of this control will be described later.

If the capping setting is "automatic," the CPU 11 moves to step S103. On the other hand, if the capping setting is "fixed," the CPU 11 moves to step S105.

At step S103, the CPU 11 analyzes head drive data. For example, the CPU 11 judges presence/absence of head drive data and calculates a time it will take to generate head drive data corresponding to the print job, the number of pages, and other parameters.

At step S104, the CPU 11 reads automatic capping judgment conditions, which are, for example, an ink type, a type of the head unit(s) 19, an ambient humidity and temperature of the head unit(s) 19, a conveyance speed of the continuous sheet P, a page length (the length of one page), presence/absence of head drive data, a non-printing (non-ejection) time, and a printing frequency. Either all or part of these parameters may be used as the automatic capping judgment conditions.

At step S105, the CPU 11 judges whether it is necessary to perform capping. If the setting "fixed" is selected, the CPU 11 manages the capping state according to the selected setting. For example, the CPU 11 keeps the head unit(s) 19 capped all the time or leaves the head unit(s) 19 uncapped all the time.

On the other hand, if the setting "automatic" is selected, the CPU 11 judges whether capping is necessary using the above-mentioned parameters.

First, the CPU 11 calculates a non-printing-possible time Tt on the basis of the ink type, the type of the head unit (s) 19, and the ambient humidity and temperature of the head unit (s) 19. That is, the CPU 11 calculates a time (determined according to a use environment) for which the ink is not dried without being capped. The non-printing-possible time Tt is an example of the "first allowable time" and the "second allowable time".

Then the CPU 11 converts the calculated non-printing-possible time Tt into a non-printing-possible page number Tp using the conveyance speed of the continuous sheet P and the page length. The non-printing-possible page number Tp is also an example of the "first allowable time" and the "second allowable time".

A fraction, smaller than one, of the conversion result non-printing-possible page number Tp is omitted. For example, if the conversion result is 3.5 pages, the non-printing-possible page number Tp is made 3 pages.

If the number of consecutive pages having no head drive data is larger than the non-printing-possible page number Tp, the CPU 11 judges that it is necessary to cap the head unit(s) 19 with the nozzle cap(s) 21. The CPU 11 also judges that capping of the head unit(s) 19 by the nozzle cap(s) 21 is necessary if a non-printing (non-ejection) time to the present time has exceeded the non-printing-possible time Tt.

If head drive data exist or the number of consecutive pages having no head drive data is smaller than or equal to the non-printing-possible page number Tp even if such pages exist, the CPU 11 judges that capping of the head unit(s) 19 by the nozzle cap(s) 21 is not necessary.

Furthermore, the CPU 11 judges, on the basis of presence/absence of head drive data, whether to cause recovery from a state that the head unit(s) 19 is covered with the nozzle cap(s) 21.

After making the above judgment at step S105, the CPU 11 moves to step S106, where the CPU 11 causes capping or uncapping of the head unit(s) 19 according to the judgment result.

In the exemplary embodiment, the CPU 11 also has a function of adjusting the capping or uncapping timing taking a use environment of the printing apparatus 2 or 3 into consideration. More specifically, the CPU 11 adjusts the capping or uncapping timing on the basis of a printing frequency (e.g., a use rate of the head unit(s) 19 or the number of times of ejection), a tendency of capping or uncapping of the setting "automatic" during printing, and other factors. Information relating to a printing frequency and information relating to a capping or uncapping tendency are read out from the RAM 13.

For example, in a use environment in which an event that uncapping is made after a lapse of a short time from capping of the setting "automatic" occurs frequently (i.e., short-time closure of the head unit(s) 19 occurs frequently), the CPU 11 delays the execution timing of capping by a preset time. Capping of the head unit(s) 19 is skipped if a judgment result "uncapping should be made" occurs during such a delay period.

This measure serves to reduce the number of times of execution of capping and uncapping operations which lower the efficiency. Although this control may cause the head unit(s) 19 not to emit ink droplets for longer than the non-printing-possible time Tt, an excess time is very short and hence no practical problems such as ink clogging are caused.

The same type of control is performed for uncapping. that is, in a use environment in which an event that capping is made after a lapse of a short time from uncapping occurs frequently (i.e., short-time opening of the head unit(s) 19 occurs frequently), the CPU 11 delays the execution timing of uncapping by a preset time. Uncapping of the head unit(s) 19 is skipped if a judgment result "capping should be made" occurs during such a delay period. This measure serves to reduce the number of times of execution of capping and uncapping operations which lower the efficiency.

When the head unit(s) 19 being uncapped is supplied with head drive data, an image is formed on the continuous sheet P by ejection of ink droplets that is performed on the basis of the head drive data.

<Example Operations>

A description will be made of example capping operations that are performed in a case that the capping setting "automatic" is selected.

Figure 6:
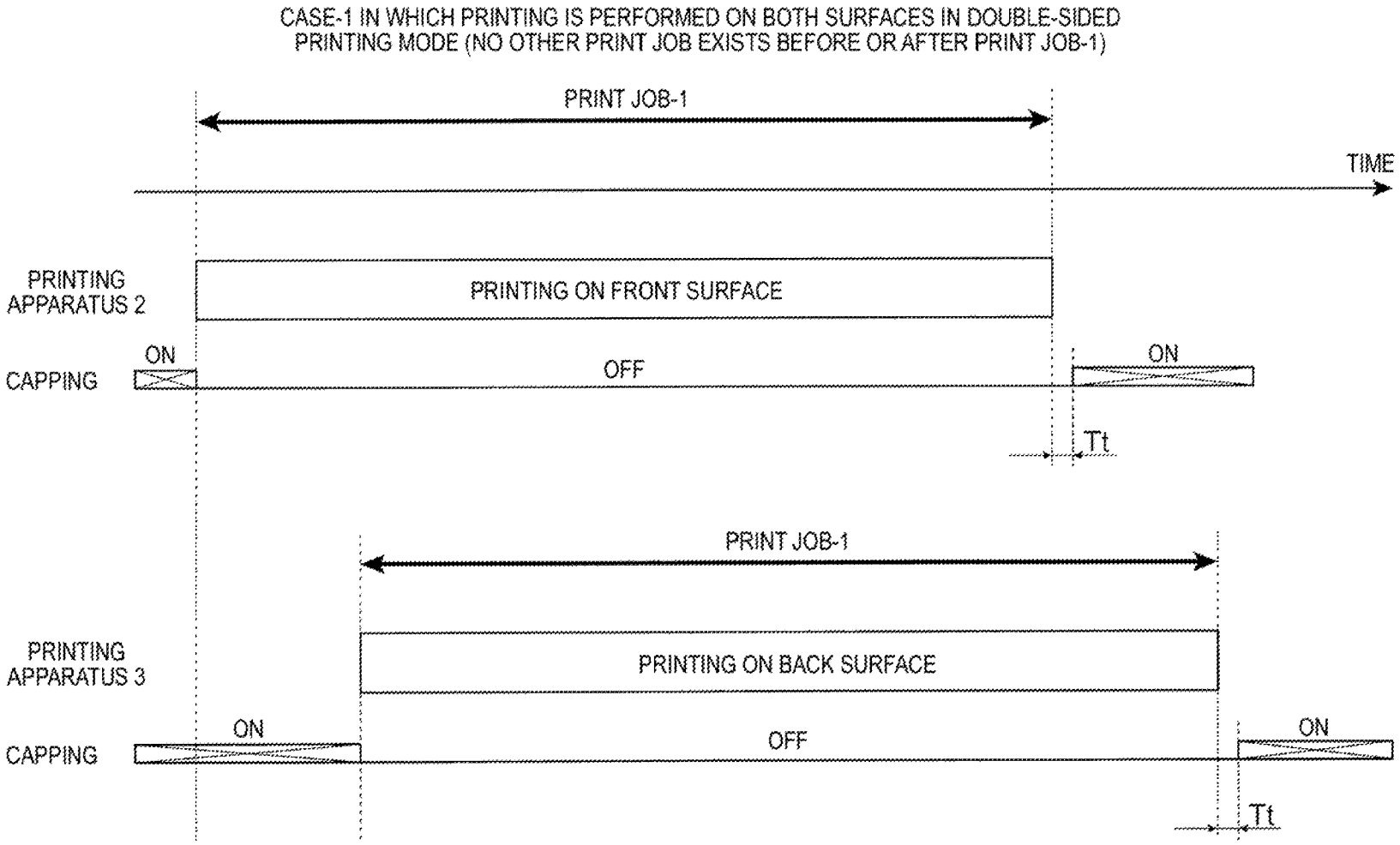
FIG. 6 illustrates a capping operation that is performed in a case that a double-sided printing mode is set in a print job and printing data exist for printing on both of the front surface and the back surface.

FIG. 6 illustrates a capping operation that is performed in a case that a double-sided printing mode is set in print job-1 and printing data exist for printing on both of the front surface and the back surface. FIG. 6 assumes that no other print job exists before or after print job-1.

In this example, before reception of print job-1, the printing apparatus 2 and 3 are both in a halt state and hence their head units 19 are capped with the nozzle caps 21.

Since printing on the front surface by the printing apparatus 2 which is disposed on the upstream side in the conveyance path of the continuous sheet P is to be started first, in the printing apparatus 2 the head unit(s) 19 is uncapped and printing of the head drive data is started.

On the other hand, in the printing apparatus 3 which is disposed on the downstream side in the conveyance path of the continuous sheet P, printing of print job-1 on the back surface cannot started and hence the capping with the nozzle cap(s) 21 is maintained until the continuous sheet P is conveyed to such a position that printing on the back surface should be started.

The above control is performed because the time it takes for the printing apparatus 3 to start printing from reception of print job-1 is longer than the non-printing-possible time Tt.

In this example, head drive data that is necessary for printing of each page is generated before a start of printing of that page on the continuous sheet P. Thus, once the printing apparatus 2 or 3 starts printing, it prints all pages without suspending printing even once.

In the example of FIG. 6, since no other print job exists that follows print job-1, a non-ejection time exceeds the non-printing-possible time Tt after completion of the printing. Thus, in the example of FIG. 6, in each of the printing apparatus 2 and 3, the head unit(s) 19 is capped after a lapse of the non-printing-possible time Tt from the completion of the printing of print job-1.

Figure 7:
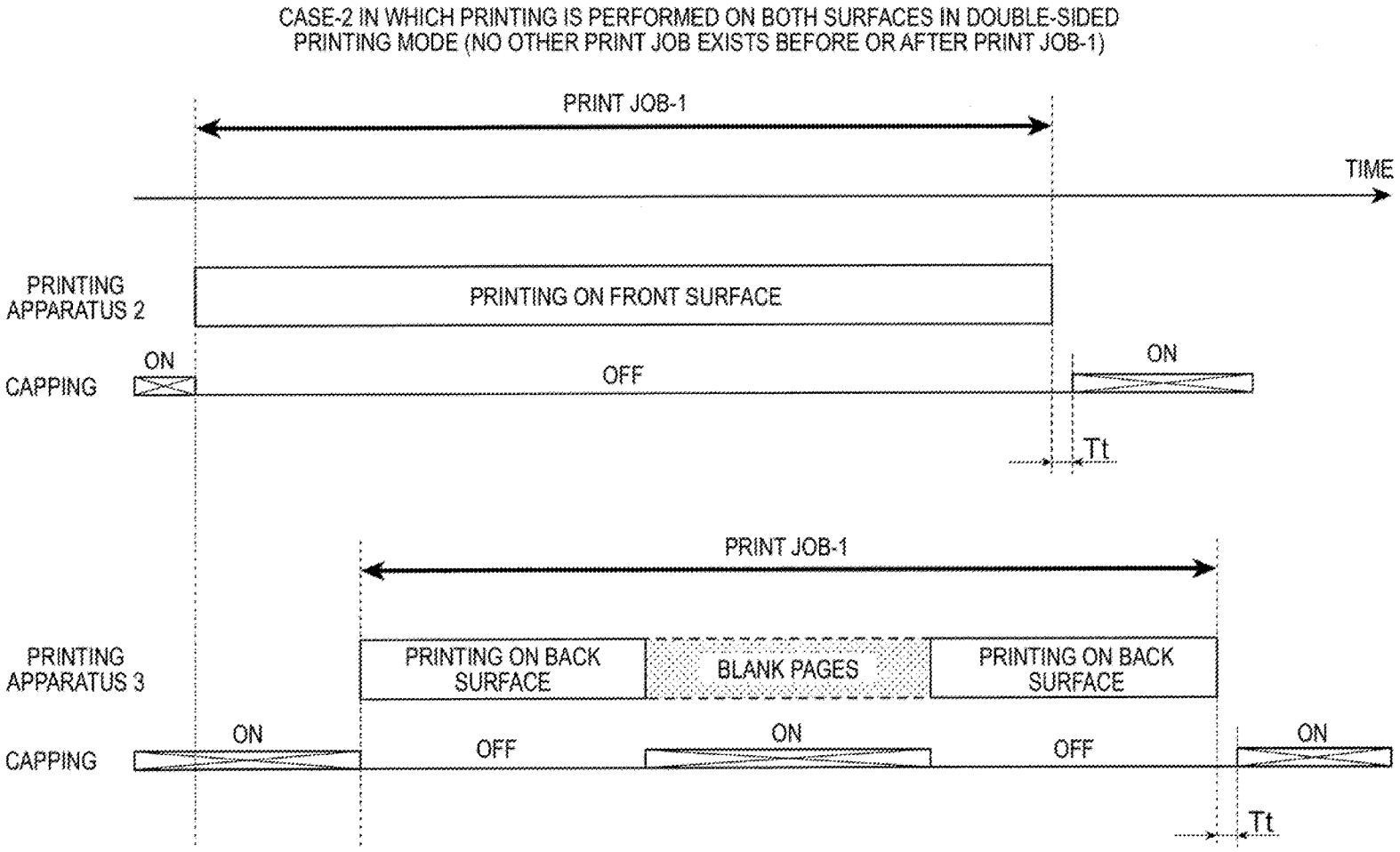
FIG. 7 illustrates a capping operation that is performed in a case that the double-sided printing mode is set in a print job and blank pages appear continuously in part of a period of printing on the back surface.

FIG. 7 illustrates a capping operation that is performed in a case that the double-sided printing mode is set in print job-1 and blank pages appear continuously in part of a period of printing on the back surface. In the example of FIG. 7, continuous blank pages the number of which is larger than the non-printing-possible page number Tp appear in part of a period of printing on the back surface by the printing apparatus 3. The part of the period of the printing on the back surface in this case is an example of the "period of printing on a surface for which no head drive data exist in double-sided printing".

In this case, continuing the printing in the state that the head unit(s) 19 of the printing apparatus 3 is kept uncapped is not preferable because ink will be dried. In the exemplary embodiment, the CPU 11 judges that the number of blank pages will exceed the non-printing-possible page number Tp and performs a control to cap the head unit(s) 19 with the nozzle cap(s) 21.

Figure 8:
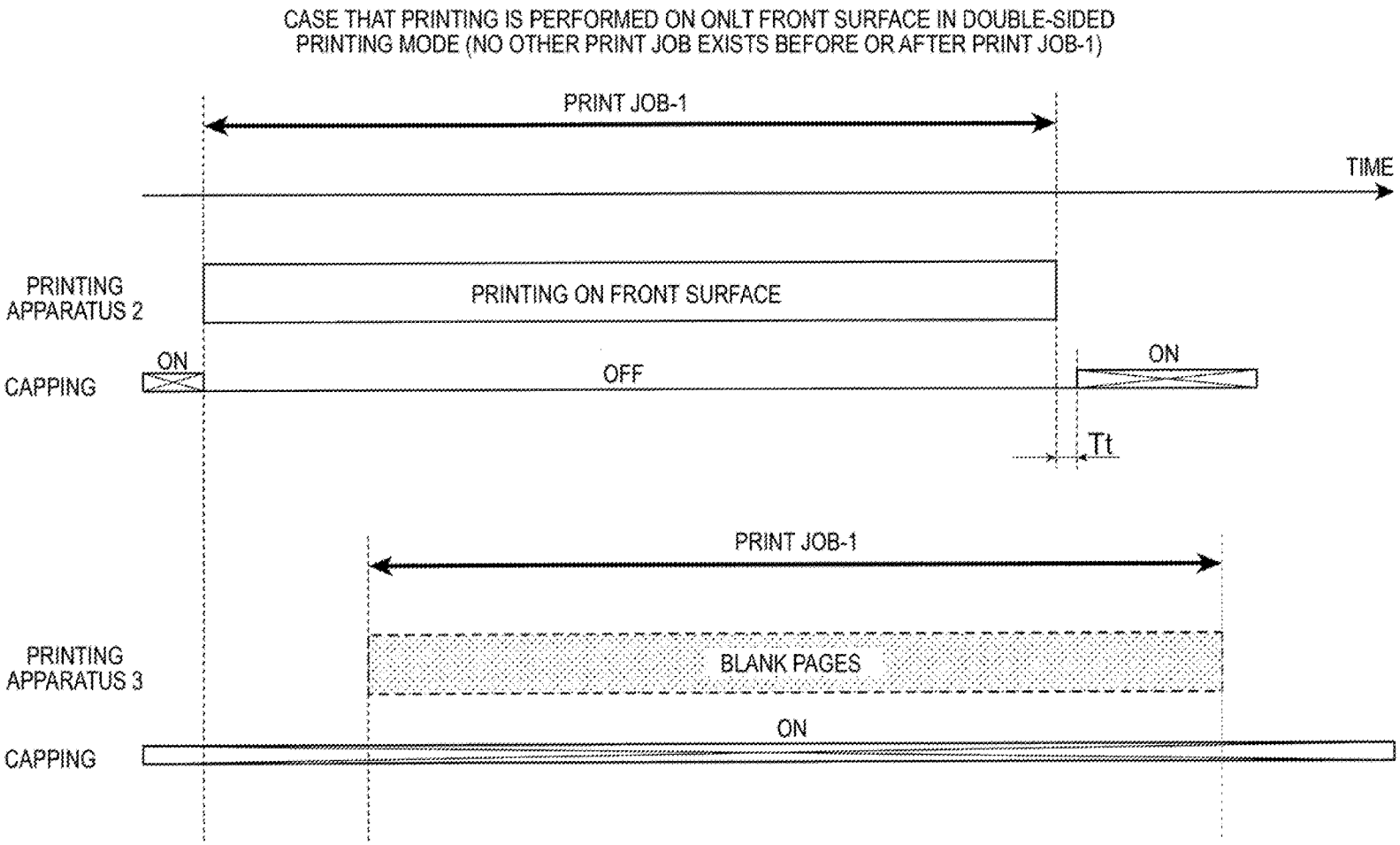
FIG. 8 illustrates a capping operation that is performed in a case that the double-sided printing mode is set in a print job and printing data exist only for printing on one surface (front surface)

FIG. 8 illustrates a capping operation that is performed in a case that the double-sided printing mode is set in print job-1 and printing data exist only for printing on the front surface. FIG. 8 assumes that no other print job exists before or after print job-1.

The back surface in this case is an example of the "surface for which no head drive data exist in double-sided printing". All of the period when printing is performed on the back surface in print job-1 is an example of the "period of printing on a surface for which no head drive data exist in double-sided printing".

This example is different from the example of FIG. 6 in that the head unit(s) 19 of the printing apparatus 3 which is disposed on the downstream side in the conveyance path of the continuous sheet P is kept capped over the entire period of print job-1.

The number of print pages of print job-1 may amount to, for example, several tens of thousands, in which case printing of print job-1 takes long time even with high-speed printers. In such a case, if a control were performed so that the head unit(s) 19 of the printing apparatus 3 is kept uncapped because the double-sided printing mode is set though the back surface should be left blank pages, nozzle clogging might occur in certain use environments.

In contrast, with the control method of the exemplary embodiment, as in the example operation of FIG. 8, in the case where images to be printed exist only for one surface when the double-sided printing mode is set, the fact that absence of head drive data will last continuously is detected and the head unit(s) 19 is capped, whereby the probability of occurrence of nozzle clogging can be lowered.

Figure 9:
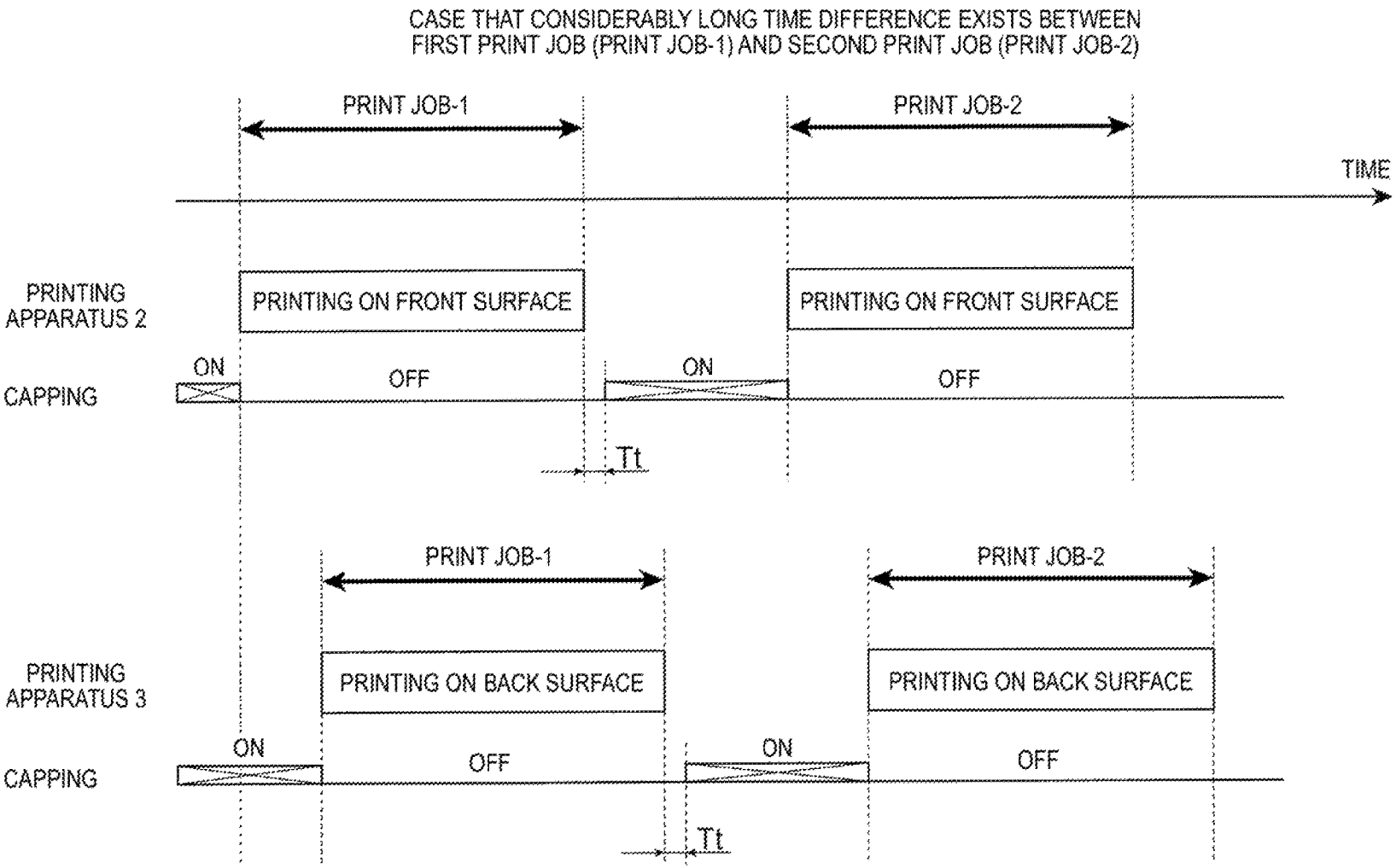
FIG. 9 illustrates a capping operation that is performed in a case that a considerably long time difference exists between a first print job and a second print job.

FIG. 9 illustrates a capping operation that is performed in a case that a considerably long time difference exists between a first print job (print job-1) and a second print job (print job-2). FIG. 9 assumes that in both of the print job-1 and print job-2 the double-sided printing mode is set and print data exist for both of the front surface and the back surface.

In the example of FIG. 9, print data of print job-2 do not arrive before a lapse of the non-printing-possible time Tt from the end of printing of print job-1. Thus, the CPU 11 of each of the printing apparatus 2 and 3 performs a control for capping the head unit(s) 19 as soon as the non-printing time exceeds the non-printing-possible time Tt.

If each of the printing apparatus 2 and 3 is supplied with print job-2 during execution of print job-1 and head drive data of print job-2 are generated before completion of a printing operation of print job-1 in each of the printing apparatus 2 and 3, each of the printing apparatus 2 and 3 continues to print images (pages) of print job-1 and images (pages) of print job-2 on the continuous sheet P.

Figure 10:
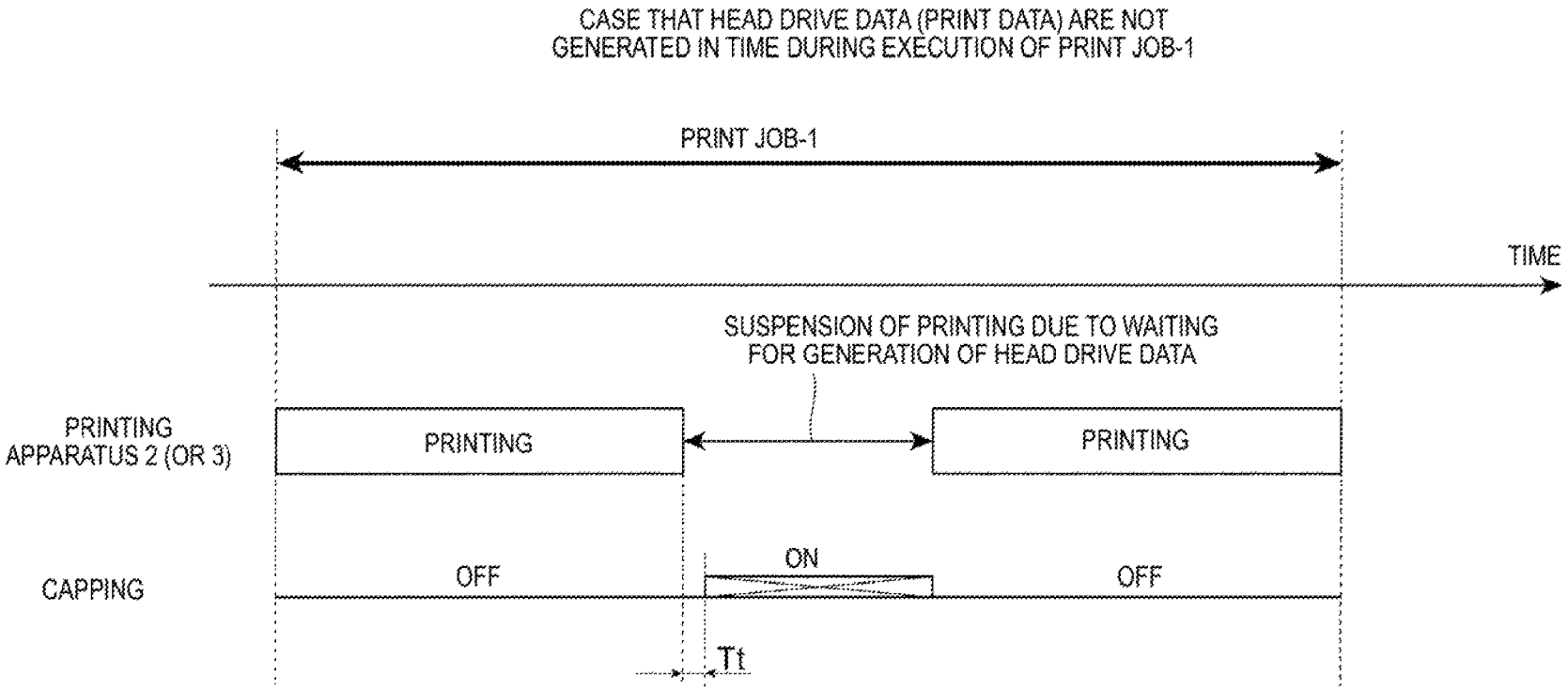
FIG. 10 illustrates a capping operation that is performed in a case that a printing operation is suspended temporarily because head drive data are not generated in time during execution of a print job.

FIG. 10 illustrates a capping operation that is performed in a case that a printing operation is suspended temporarily because head drive data are not generated in time during execution of print job-1.

In the case of FIG. 10, in a common capping control, a control is performed to keep the head unit(s) 19 uncapped because print job-1 is being carried out. However, with such a control, if the printing suspension time due to waiting for generation of head drive data is long, ink may be dried to cause nozzle clogging.

In view of the above, in the example of FIG. 10, a control for capping the head unit(s) 19 is performed as soon as the non-printing time exceeds the non-printing-possible time Tt. In this manner, in the case where a long non-printing time occurs though a print job is being carried out, the head unit(s) 19 is capped to eliminate a cause of nozzle clogging.

Figure 11:
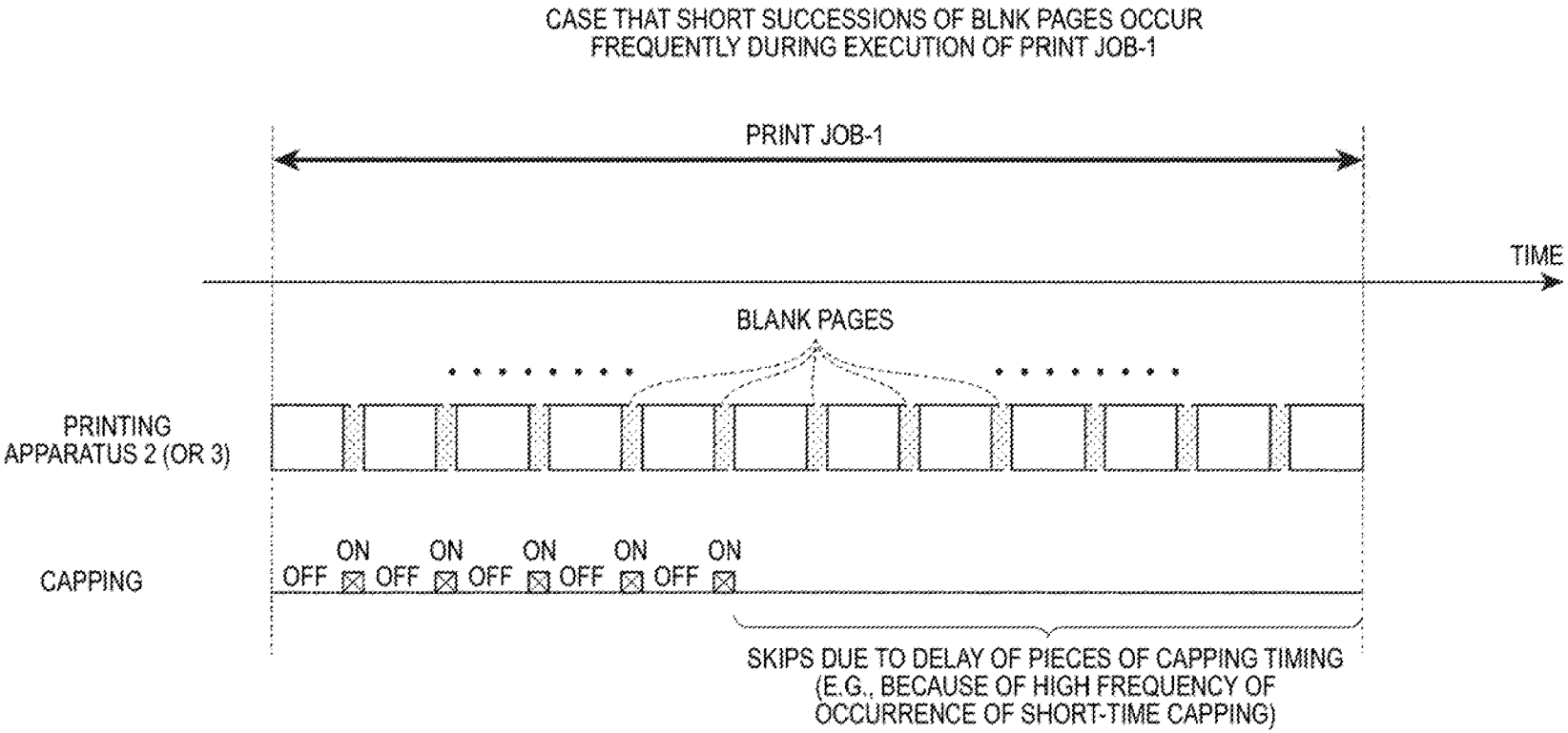
FIG. 11 illustrates a capping operation in which the capping timing is adjusted.

FIG. 11 illustrates a capping operation in which the capping timing is adjusted. In the example of FIG. 11, an event that blank pages continue beyond the non-printing-possible page number Tp occurs frequently during execution of print job-1.

As shown in FIG. 11, in a first half of print job-1, the head unit(s) 19 is capped every time the number of blank pages exceeds the non-printing-possible page number Tp. However, in a second half of print job-1, capping is skipped because the CPU 1 has detected frequent occurrences of short-time capping and delays pieces of capping timing.

As a result, the number of times of execution of a capping operation which lowers the efficiency is reduced. The CPU 11 judges that the capping time is short if it is shorter than a predetermined threshold value.

<Advantages>

As described above, according to the first exemplary embodiment, even in a situation that blank pages appear continuously during printing or a non-ejection state continues due to a delay of generation of head drive data, the head unit(s) 19 can be capped reliably and hence ink can be prevented from being dried. As a result, the ink consumption and the staining of the continuous sheet P can be suppressed that are caused by dummy jetting or purge processing that are performed to prevent ink drying.

Furthermore, since the number of times of execution capping (or uncapping) which lowers the efficiency can be reduced, the non-operation periods of the printing apparatus 2 and 3 can be shortened.

Exemplary Embodiment 2

Although the above-described first exemplary embodiment is directed to the case of double-sided printing using the cascade printing system 1 in which the two printing apparatus 2 and 3 are connected to each other in cascade, the control technique described in the first exemplary embodiment can also be applied to double-sided printing using a single printing apparatus.

Figure 12:
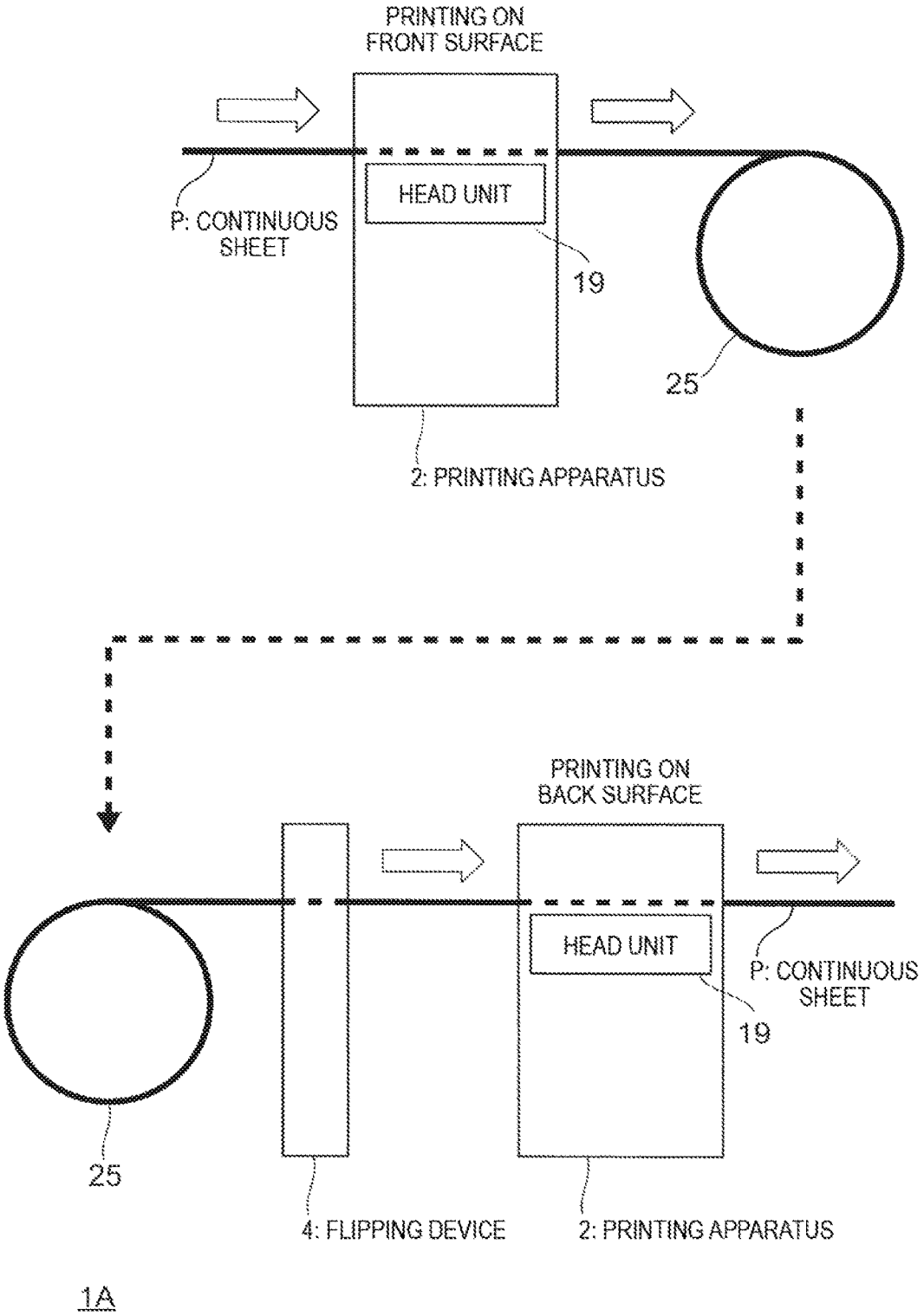
FIG. 12 is a block diagram showing an example overall configuration of a printing system which performs double-sided printing using a single printing apparatus.

FIG. 12 is a block diagram showing an example overall configuration of a printing system 1A which performs double-sided printing using a single printing apparatus 2. In FIG. 12, constituent elements having corresponding ones in FIGS. 1 and 2 are given the same reference symbols.

The printing system 1A performs double-sided printing in such a manner that printing is performed on the front surface of a continuous sheet P using the printing apparatus 2 and a printed part of the continuous sheet P is wound around a reel 25.

After completion of the printing on the front surface, the reel 23 is moved to the sheet supply side of the printing apparatus 2 and a paid-out part of the continuous sheet P is flipped by a flipping device 4 and conveyed to the printing apparatus 2 again. Then the printing apparatus 2 performs printing on the back surface of the continuous sheet P.

Also in this exemplary embodiment, the head unit 19 is capped when necessary when printing is started or blank pages appear continuously during printing, whereby ink is prevented from being dried. As a result, the amount of ink that is consumed to prevent ink drying can be reduced and the degree of staining of the continuous sheet P can be lowered.

Exemplary Embodiment 3

Figure 13:
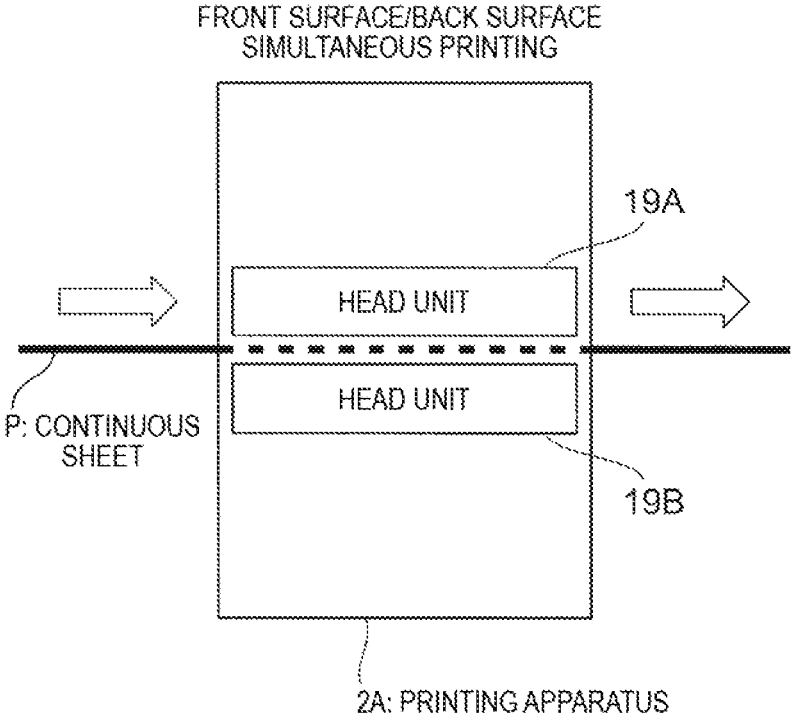
FIG. 13 shows an example configuration of a printing apparatus which is equipped with, inside, a head unit for printing on the front surface of a continuous sheet and a head unit for printing on its back surface.

FIG. 13 shows an example configuration of a printing apparatus 2A which is equipped with, inside, a head unit 19A for printing on the front surface of a continuous sheet P and a head unit 19B for printing on its back surface. The printing apparatus 2A is configured so as to perform printing on both of the front surface and the back surface of the continuous sheet P at the same time.

Also in the thus-configured printing apparatus 2A, if the number of continuous blank pages exceeds the non-printing-possible page number Tp during printing, one or both of the head units 19A and 19B are capped during processing for those pages, whereby ink is prevented from being dried. As a result, the amount of ink that is consumed to prevent ink drying can be reduced and the degree of staining of the continuous sheet P can be lowered.

Other Exemplary Embodiments

Each of the above-described exemplary embodiments is directed to the case of using the printing apparatus of the single-pass printing type, the invention can also be applied to a case of using (a) printing apparatus that perform scan-type printing on a continuous sheet P.

The scan-type printing is a printing method in which an image is printed by reciprocating a head unit 19 in the direction that crosses the feeding direction of a continuous sheet P. Where plural head units 19 are driven by the scan-type method, plural head units 19 that are arranged in the direction that crosses the feeding direction of a continuous sheet P may be reciprocated as a single block. An alternative configuration is possible in which plural head units 19 are arranged so as to offset from each other in the feeding direction of a continuous sheet P and are reciprocated in the direction that crosses the feeding direction of the continuous sheet P.

Although the above-described exemplary embodiments assume use of the belt-like continuous sheet P, the concepts of those exemplary embodiments can also be applied to (a) printing apparatus for performing printing on a very large number of cut sheets. For example, nozzle clogging due to drying of ink can be avoided by applying the concept of each exemplary embodiment to a case that blank pages the number of which exceeds the non-printing-possible page number Tp appear continuously while printing is performed continuously on a very large number of cut sheets.

Although the exemplary embodiments have been described above, the technical scope of the invention is not limited to those exemplary embodiments. It is apparent from the claims that the technical scope of the invention encompasses what are obtained by making various changes or improvements on the exemplary embodiments.

What is claimed is:

1. An image forming system comprising:

a first image forming apparatus that is disposed at an upstream side in a feeding direction of a belt-like continuous recording medium; and a second image forming apparatus that is disposed at a downstream side in the feeding direction of the recording medium, wherein each of the first image forming apparatus and the second image forming apparatus comprises:

a recording head that forms images on the recording medium by ejecting droplets from ejection outlets of the recording head;

a closing member that serves to close the ejection outlets; and a controller that monitors head drive data for driving of the recording head, and closes the ejection outlets with the closing member in case a droplets non-ejection state determined from the monitored head drive data is beyond a predetermined first allowable condition during printing, the droplets non-ejection state being a period of time during which no ink droplets are ejected from a recording head.

2. The image forming system according to claim 1, wherein one of the first image forming apparatus and the second image forming apparatus is for printing on a front surface of the recording medium and other of the first image forming apparatus and the second image forming apparatus is for printing on a back surface of the recording medium.

3. The image forming system according to claim 2, wherein in case at least part of the head drive data are only for one surface of the recording medium in double-sided printing, the controller closes, with the closing member, the ejection outlets of the recording head of one, to be used for printing of the other surface for which no head drive data exist, of the first image forming apparatus and the second image forming apparatus.

4. The image forming system according to claim 1, wherein the controller determines the first allowable condition according to a printing environment.

5. The image forming system according to claim 4, wherein the controller determines the first allowable condition based on a non-ejection allowable time that is determined according to the printing environment, a conveyance speed of the recording medium, and a one-page length.

6. The image forming system according to claim 1, wherein the controller delays timing of closure of the ejection outlets by the closing member in case short-time closure of the ejection outlets by the closing member has occurred a number of times.

7. The image forming system according to claim 1, wherein the controller closes the ejection outlets with the closing member in case the droplets non-ejection state is beyond a second allowable condition at a start of the printing.

8. An image forming apparatus comprising:

a recording head that forms images on a recording medium by ejecting droplets from ejection outlets of the recording head;

a closing member that serves to close the ejection outlets; and a controller that monitors head drive data for driving of the recording head, and closes the ejection outlets with the closing member in case a droplets non-ejection state determined from the monitored head drive data is beyond a predetermined first allowable condition during printing, the droplets non-ejection state being a period of time during which no ink droplets are ejected from a recording head.

9. The image forming apparatus according to claim 8, wherein the recording medium is a belt-like continuous recording medium.

10. The image forming apparatus according to claim 9, wherein in case at least part of the head drive data are only for one surface of the recording medium in double-sided printing, the controller closes the ejection outlets with the closing member during printing of the other surface, for which no head drive data exist, of the recording medium.

* * * * *